US008888893B2

(12) United States Patent
Lenz

(10) Patent No.: US 8,888,893 B2
(45) Date of Patent: Nov. 18, 2014

(54) METHOD FOR RECLAIMING AN EVAPORATED LIQUID FROM AN AIR STREAM AND DEVICE FOR PERFORMING THE METHOD

(75) Inventor: Bernhard Lenz, Frankfurt (DE)

(73) Assignee: Karlsruher Institut für Technologie, Karlsruhe (DE)

( * ) Notice: Subject to any disclaimer, the term of this patent is extended or adjusted under 35 U.S.C. 154(b) by 158 days.

(21) Appl. No.: 13/386,060

(22) PCT Filed: Jul. 14, 2010

(86) PCT No.: PCT/EP2010/060159

§ 371 (c)(1),
(2), (4) Date: Mar. 11, 2012

(87) PCT Pub. No.: WO2011/009791

PCT Pub. Date: Jan. 27, 2011

(65) Prior Publication Data

US 2012/0192715 A1 Aug. 2, 2012

(30) Foreign Application Priority Data

Jul. 22, 2009 (DE) ..... 10 2009 026 228
Nov. 25, 2009 (DE) ..... 10 2009 044 653

(51) Int. Cl.

| | |
|---|---|
| ***B01D 53/06*** | (2006.01) |
| ***F24F 3/14*** | (2006.01) |
| *F28D 19/04* | (2006.01) |

(52) U.S. Cl.

CPC ..... *F24F 3/1423* (2013.01); *F24F 2203/1036* (2013.01); *F24F 2203/1048* (2013.01); *F24F 2203/1052* (2013.01); *F28D 19/044* (2013.01)

USPC ..... 95/122; 96/125

(58) Field of Classification Search

USPC ..... 95/113–115, 117, 122, 123, 148; 96/125, 144; 62/94, 271, 480

See application file for complete search history.

(56) References Cited

FOREIGN PATENT DOCUMENTS

| | | |
|---|---|---|
| DE | 3020647 A1 | 12/1980 |
| EP | 0127683 A1 | 12/1984 |

OTHER PUBLICATIONS

JP 2005 058937 A (Seibu Giken KK) Mar. 10, 2005 with abstract.
JP 2005 055049 A (Seibu Giken KK) Mar. 3, 2005 with abstract.
JP 2004 209420 A (Tokyo Boseki) Jul. 29, 2004 with abstract.
JP 2003 126641 A (Daikin Ind Ltd) May 7, 2003 with abstract.
JP 10 128035 A (Matsushita Seiko KK) May 19, 1998 with abstract.
JP 57 041592 A (Matsushita Electric Ind Co Ltd)Mar. 8, 1982 with abstract.
International Search Report for corresponding International Application PCT/EP2010/060159.

*Primary Examiner* — Frank Lawrence
(74) *Attorney, Agent, or Firm* — WRB-IP LLP

(57) ABSTRACT

A method is provided for reclaiming an evaporated liquid from an air stream including transferring the evaporated liquid from a first quantity of air into a second quantity of air, wherein the second quantity of air is smaller than the first quantity of air. A device for performing the method is also provided.

9 Claims, 3 Drawing Sheets

METHOD FOR RECLAIMING AN EVAPORATED LIQUID FROM AN AIR STREAM AND DEVICE FOR PERFORMING THE METHOD

The invention relates to a method for reclaiming an evaporated liquid from an air stream.

In the field adsorption chillers and absorption chillers are known that generate a cooling effect by means of evaporating a cooling agent with said cooling effect being used for air conditioning closed premises, for example. Sorption or desorption, respectively, of the cooling agent usually also are associated with a change in the aggregate state of the cooling agent or, respectively, cause such a change.

Often the cooling agent used is water, for example, that is stored in a suitable sorption agent during sorption, such as silica gel or zeolite. During a subsequent desorption the cooling agent can be evaporated again by heating the sorption agent.

The adsorption or, respectively, absorption of the cooling agent is facilitated by a low temperature and high pressure. For this reason sorption chillers either are operated at low working pressure that ranges significantly below the typical atmospheric, pressure or preferably are used for air conditioning rooms in geographic regions in which the mean temperature values are not exceedingly high so that the ambient temperature or, respectively, exterior temperature in most cases allows for suitable operating conditions for the sorption chillers and in addition only minimal cooling performance is required for air conditioning premises to levels that are perceived to be pleasant. The energy required for operating the sorption chillers should be provided by environmental energy (solar energy, geothermal energy), for example, or by waste heat.

However, air conditioning closed premises is of special interest in hot geographic regions with high mean day temperatures, especially since sufficient amounts of solar energy are available at low cost due to the abundant sunlight that can be used to operate the sorption chillers.

In order to ensure a sufficiently efficient adsorption of a cooling agent it usually is necessary to cool the sorption agent. However, starting at an ambient temperature in excess of 30° C. it often is no longer possible provide the cooling of the individual components that is required for an efficient operation of the adsorption chiller using a convective now or an artificially generated flow using ambient air. In these cases evaporative cooling can be used that can be achieved without requiring any significant equipment. For example, by spraying the surfaces and components to be cooled with water latent heat of evaporation is generated and it is possible to operate the adsorption chiller even at high ambient temperatures. In the same manner evaporative cooling or other cooling processes in which water or a different liquid cooling agent vaporizes or respectively, evaporates can be used exclusively for cooling or to support cooling in any type of chiller that is based on the use of one or a plurality of heat exchangers.

The water that is used for and evaporates during cooling increases the moisture content in the vicinity of the surfaces and components to be cooled and usually is dissipated together with the used air. Consequently, evaporative cooling requires continuous water consumption. However, especially in hot and therefore often and geographic regions continuous water consumption is not economical and should be avoided.

The moisture content of the used air regularly is too low and therefore does not allow for any significant condensation and thus reclaiming of the evaporated liquid carried along in the used air without requiring a new elaborate and energy-intensive cooling of the used air. However, active cooling of the moist used air, just like intermediate process steps with considerable excess pressure or negative pressure, is not economical and would require elaborate steps in connection with manufacture assembly and operation of such equipment.

Therefore, it is desirable to provide a method for reclaiming an evaporated liquid from an air stream so that at least a part of the evaporated liquid can be reclaimed from a first quantity of air even at high ambient temperatures of 30° C. or higher without having to generate any excessive cooling effect or change in pressure that would require a high amount of energy in order to affect the condensation and reclaiming of the evaporated liquid.

In an aspect of the invention evaporated liquid is transferred from a first quantity of air into a second quantity of air, wherein the second quantity of air is smaller than the first quantity of air. Preferably the evaporated liquid from a first quantity of air is sorbed in a sorption agent and then desorbed in a second air quantity, wherein the second air quantity is smaller than the first air quantity. Instead of using adsorption, it also is possible to use absorption of the liquid and subsequent desorption.

The sorption agent can be any material that is suitable to take up and store sufficient quantities of water or water vapor in order to subsequently release the taken up quantity of water. Sorption agents can be, for example, porous materials with a large surface to volume ratio. Sorption agents can also be suitable plastics materials or liquids or gasses.

The invention is based on the knowledge that a suitable increase in the dew point temperature favors the formation of condensate and, given suitable conditions, can force significant formation of condensate and thus a reclaiming of the moisture contained in the quantity of air when it is cooled to the ambient temperature.

Since the dew point temperature for a given atmospheric pressure is significantly determined by the total amount of moisture contained in the quantity of air or, respectively, by the amount of water contained in the quantity of air, the dew point temperature can simply be increased by using a decisively smaller quantity of air for a desorption of the amount of liquid sorbed in the sorption agent than for the sorption of the same amount of liquid from the quantity of air that is dried in the process. If the moisture content in the second quantity of air is sufficiently high and the respective dew point temperature is above the ambient temperature, a cooling of the second quantity of air to the ambient temperature can cause a large part of the moisture content of the second quantity of air to condense.

The method according to the invention described above is not limited to the use in connection with air conditioning or cooling. Rather, the method according to the invention also makes it possible to extract drinking water from ambient air by condensing the moisture contained in the ambient air.

Usually drinking water is obtained from ground or surface water or by desalinating sea water. In dry and hot geographic regions it is not possible to produce significant amounts of pound water and due to the lack of precipitation it is very difficult to efficiently collect and use surface water. Desalination of sea water requires access to coastal areas, which is not the case in many countries and geographic regions.

Contrary to the methods known up until now the method according to the invention makes it possible to extract moisture from ambient air and condense water even in dry and hot geographic regions without requiring any energy-intensive lowering of the temperature or increasing the pressure of the ambient air, which would make such a method uneconomical.

To extract water vapor from the ambient air and to obtain drinking water, it is possible to suction in ambient air, dehumidify it in a sorption agent and then release it again. An air stream is circulated in a process air cycle with the temperature and absolute moisture content of the air stream being specified based on the external temperature so that the moisture deposited in the sorption agent by a first, large quantity of ambient air can be taken up by a warmed up second, small quantity of air in the process air cycle. Subsequently the second quantity of air in the process air cycle is cooled again so that a large part of the moisture contained therein is condensed and can be collected as drinking water.

Contrary to the already known methods in which the ambient air is cooled or compressed in order to cause the moisture contained therein to condense, the moisture is transferred into a second, pre-conditioned quantity of air that allows for a substantially more efficient condensing of the moisture transferred into this quantity of air.

According to an advantageous embodiment of the inventive thought the first quantity of air and the second quantity of air have the same atmospheric pressure. This atmospheric pressure substantially corresponds to the atmospheric pressure of the ambient an or respectively, to the local atmospheric pressure under normal conditions. An artificial change of the atmospheric pressure and the generation of a vacuum that may be required are not necessary. It is not necessary to manufacture and operate a pressure-resistant device that works at negative pressure and excess pressure for reclaiming the liquid.

Preferably the second quantity of air is smaller than a marginal quantity of air for desorption of a specified amount of liquid from the sorption agent with the dew point temperature [of the marginal quantity of air] corresponding to a specified minimum temperature following the taking up of the desorbed amount of liquid. In a first step it can be specified which amount of liquid is to be extracted from the first quantity of air that is first sorbed in the sorption agent and then is added to the second quantity of air using desorption. The amount of the second quantity of air then is expediently specified so that the amount of liquid added following desorption can be condensed again and reclaimed for the most part by suitably increasing the dew point temperature of the second quantity of air with subsequent cooling of this second quantity of air to the ambient temperature. The dew point temperature is the result of the amount of the second quantity of air and the moisture taken up therein.

In order to provide for an efficient operation of the adsorption chiller and an extensive reclaiming of the cooling water that is used for cooling purposes, it is expedient to make the specified dew point temperature higher than an external temperature under typical operating conditions. The dew point temperature should be higher than the ambient temperature that is used to cool the second quantity of air that typically was heated to 75° C. and higher for the desorption process.

According to an advantageous embodiment of the inventive thought it is planned that following desorption of the liquid stored in the sorption agent the second quantity of air is transferred to a heat exchanger that cools the second quantity of air. The amount of condensate that is produced during the cooling of the second quantity of air can be collected and used again for evaporative cooling, for example. The evaporative cooling may include the sorption agent, if necessary, since the sorption agent heats up during the adsorption of water and an excessive warming of the sorption agent should be avoided.

To reduce a loss of water or use of cooling liquid, it is possible to circulate the second quantity of air in a closed cycle. A loss of water can be avoided fir the most part or completely by circulating the first quantity of an in a closed cycle as well having the evaporative cooling occur inside this cycle. It also is possible and under certain conditions expedient, to guide one or both quantities of air in an open and not in a closed cycle.

To be able to extract drinking water from the ambient air, the first quantity of air is suctioned from the ambient air. The first quantity of air is not circulated in a closed cycle to allow for a cooling of the an conditioning air suctioned from the environment, but rather is taken continuously from the ambient air in order to at least partially condense its moisture and to be able to extract drinking water efficiently in this manner by using the above described method.

To be able to transfer a high share of moisture from the ambient air to the sorption agent, the first quantity of air is cooled before the moisture contained therein is sorbed in a sorption agent and then is desorbed in a second quantity of air. The cooling can be carried out using a heat exchanger or can be carried out naturally by allowing it to flow through an underground tunnel or such, for example.

The moisture that is transferred into the sorption agent is desorbed from the sorption agent by means of a second quantity of air that is suitably pre-conditioned wherein the dew point temperature of the second quantity of air preferably is significantly above the ambient air following the taking up of the moisture from the sorption agent. Due to the subsequent cooling of the second quantity of air the moisture contained therein is condensed for a large part and can then be collected and made available so it can be treated and made available as drinking water or useable water.

The invention also relates to a device for carrying out the above described method for reclaiming, an evaporated liquid from an air stream wherein the evaporated liquid is sorbed in a sorption agent and then desorbed. According to the invention the device comprises a container having a plurality of rotationally supported chambers that are filled with the sorption agent and are permeable by an air flow. By using a container with rotationally supported sorption chambers permeated by an air flow, an adsorption process of a first quantity of air can be carried out in a chamber on one side of the container and simultaneously a desorption process in a second quantity of air can be carried out in a chamber on another, preferably opposite side of the container. In doing so, it is possible to have continuous operation of the device and thus a continuous reclaiming of the moisture adsorbed from the first quantity of air.

In an advantageous manner the device comprises a setup for guiding the air flow that forms a closed cycle and guides an air flow through at least one chamber of the container and then through a heat exchanger. The air flow guide can be a flow channel whose course is adapted to the spatial conditions.

In order to facilitate the collection, intermediate storage and provision of the reclaimed liquid, the device comprises a collecting setup for the liquid that is condensed from the second quantity of air.

According, to an advantageous embodiment of the inventive thought the container comprises circularly disposed, rotationally supported chambers that are filled with a sorption agent and comprise inflow openings as well as outflow openings disposed at a distance for an air flow. The circularly disposed chambers can comprise inflow and outflow openings arranged in radial direction that enter into the inflow areas or outflow areas, respectively, of the respective air flow guide. In addition to an air flow guide for the second quantity of air an air flow guide for the first quantity of air can form a closed cycle and simultaneously allow for the permeation of chambers of the container that are arranged at a distance.

BRIEF DESCRIPTION OF THE DRAWINGS

In the following paragraphs the embodiments of the inventive thought that are shown in the drawing are described in more detail. The following is shown.

DETAILED DESCRIPTION

Figure 1:
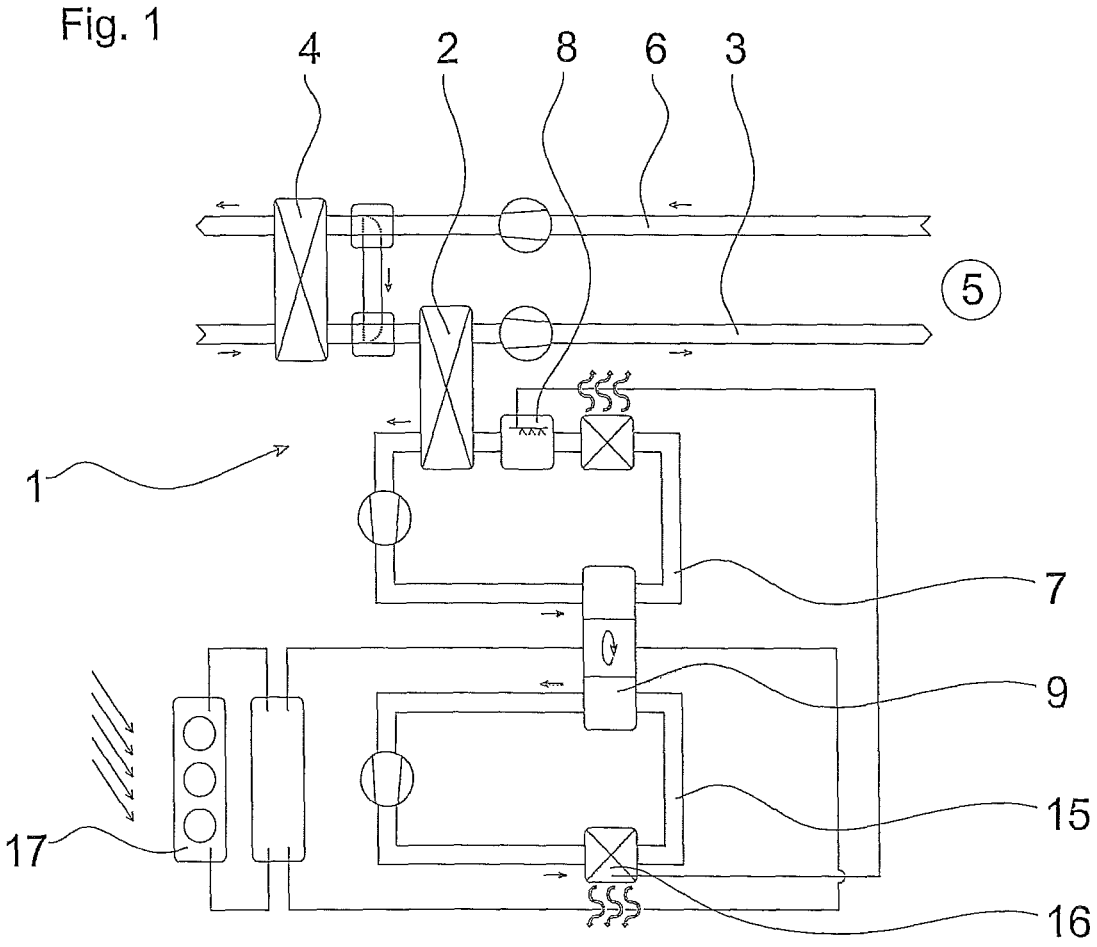
FIG. 1 shows as schematic view of a device and the course of the method of a chiller for air conditioning premises in which evaporative cooling is used and the sprayed cooling water is reclaimed in a second cycle.

The chiller 1, of which only a schematic view is shown in FIG. 1, by means of a first heat exchanger 2, cools in incoming air stream 3 suctioned from the surroundings. By means of an upstream second heat exchanger 4 the incoming air stream 3 is pre-conditioned whereby typically cooling as well as a drying of the incoming air stream 3 can be considered for pre-conditioning. In a cooling process carried out in the first heat exchanger 2 the incoming air of the incoming air stream 3 is cooled to the desired temperature of the incoming air. The incoming air subsequently is introduced into the air conditioned premises 5 and removed again as a used air stream 6.

To provide for an effective operation of the chiller, the cooling agent that flows into the heat exchanger 2, a cooling air stream 7 that substantially flows at ambient air pressure, must be cooled by means of evaporative cooling 8. Deionized cooling water is transferred to the cooling air stream 7 by means of evaporative cooling 8 so that the result is an adiabatic evaporation of the cooling water in the cooling air stream 7 which is why the moisture of the cooling air stream 7 increases and its temperature decreases.

The cooling air stream 7 is guided in a closed cycle through a container 9, which is described in more detail in connection with FIGS. 2 and 3, said container comprising chambers 11 that are rotationally supported and are filled with a sorption agent 10. The chambers 11 are circularly disposed and connected to each other so that the chambers 11 form a rotationally supported ring of chambers 12 that substantially is completely filled with the sorption agent 10. Inside the ring of chambers 12 as well as outside the ring of chambers 12 circular segment shaped supply and removal chambers 13 are arranged concentrically, said chambers being connected to the cycle of the cooling air stream 7. The individual chambers 11 as well as the supply and removal chambers 13 comprise inflow and outflow openings 14 that allow the cooling air stream 7 to flow from a supply chamber 13 through the sorption agent filled chambers 11 into the respective removal chamber 13. The direction of flow of the cooling air stream 7 can be arbitrarily specified so that the cooling air stream 7 either flows from inside to outside or from outside to inside through the chambers 11. Depending on the direction of flow of the air stream that flows through, the chambers 13 surrounding the ring of chambers 12 either are supply chambers 13 or removal chambers 13.

The ring of chambers 12 is rotationally supported between the spatially fixed supply and removal chambers 13 and can be driven by a motor and brought into a continuous or interval-based rotational motion. Two supply chambers 13 each and two corresponding removal chambers 13 are arranged around the ring of chambers 12 so that a first an stream, for example the cooling air stream 7, and a second an stream can simultaneously flow through different chambers 11. While sorption of moisture from the cooling air stream 7 occurs in some chambers 11, desorption of the moisture stored in the sorption agent 10 can already occur in the opposite chambers 11.

Figure 2:
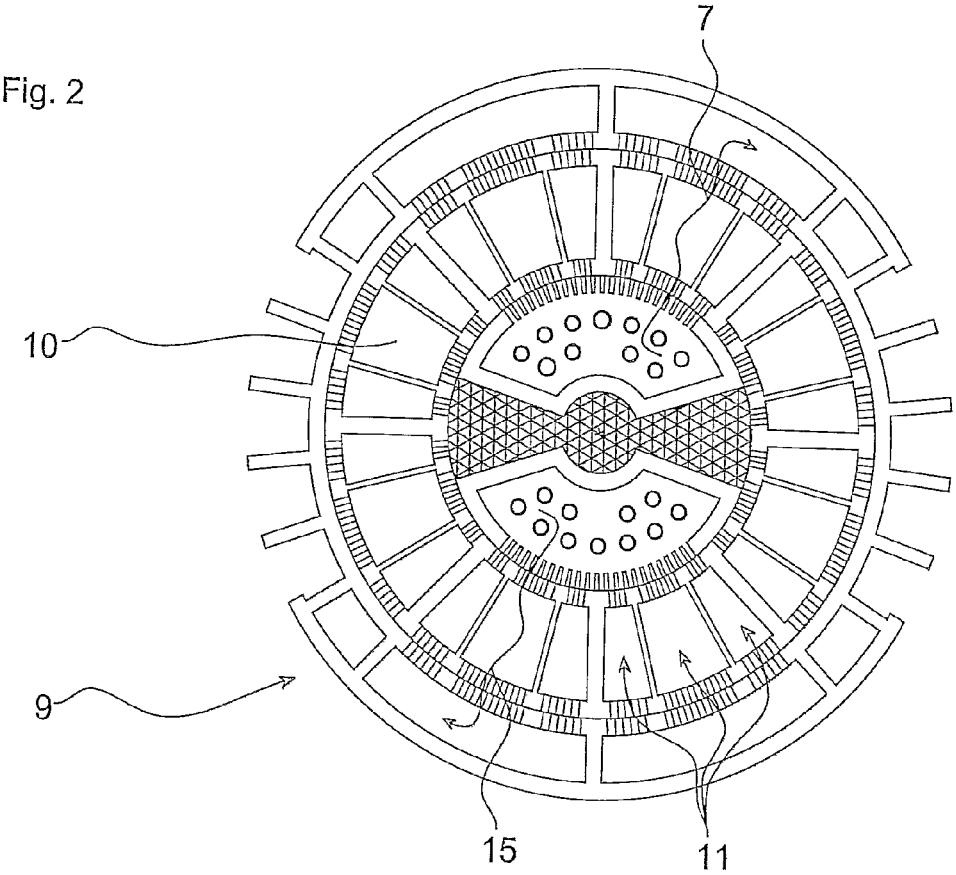
FIG. 2 shows a schematic view of a container with rotationally supported sorption chambers.
Figure 3:
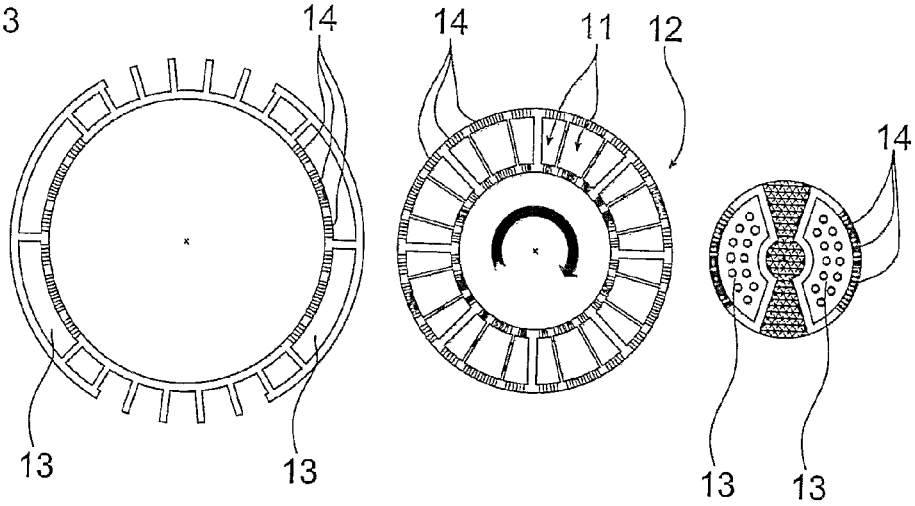
FIG. 3 shows a smaller and drawn out view of the container shown in FIG. 2
Figure 4:
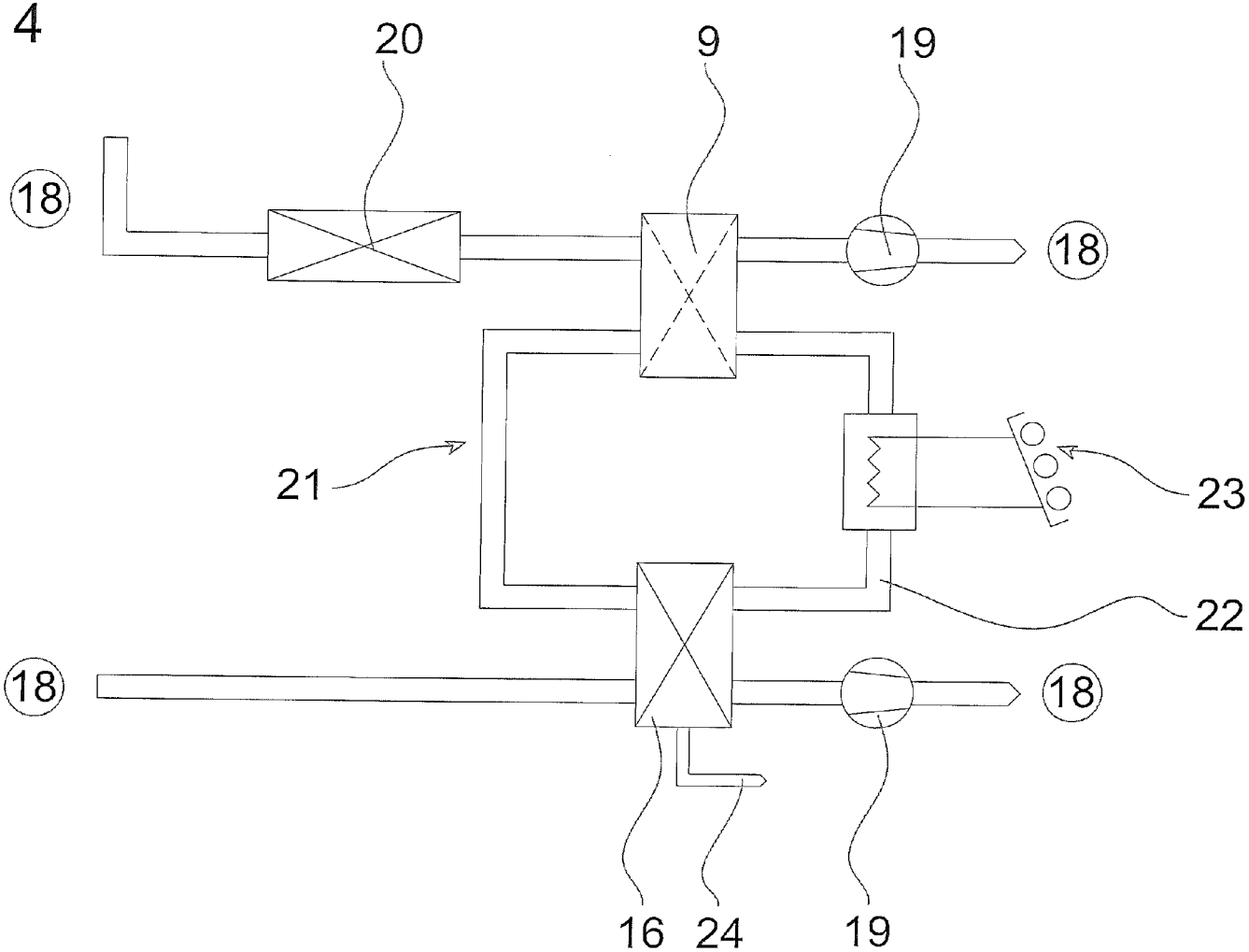
FIG. 4 shows a schematic view of a device and course of the method for extracting drinking water from ambient air.

FIGS. 2 and 3 show an example of a sectional view of the container 9. The container 9 can have a cylinder shape and can be of almost any length so that the amount of the permeable sorption agent 10 can be specified almost arbitrarily and can be adapted to the respective requirements. By way of the arrangement and design of the inflow and outflow openings 14 one can ensure that during the rotational motion of the ring of chambers 12 a substantially constant free flow cross-section is provided between the supply and removal chambers 13 at all times so that there are no perceivable pressure fluctuations during operation.

In addition to the cooling air stream 7 a desorption air stream 15 is guided through the container 9. To make this clearer, a simultaneous flow through the container 9 of the cooling air stream 7 and the desorption air stream 15 is indicated as an example in FIG. 2.

While flowing through the sorption agent 10 filled chambers 11, the heated desorption air stream 15 takes up the moisture stored therein. The volume flow rate of the desorption air stream 15 is smaller than the volume flow rate of the cooling air stream 7. Studies have shown that, for example, a factor of 10 between the two volume flow rates is suitable while the assumption is that, independent of the respective volume flow rate, the sorption of moisture per unit of time or, respectively, the subsequent desorption of moisture in or, respectively from the sorption agent is approximately constant. Due to the low volume flow rate of the desorption air stream 15 a correspondingly smaller second quantity of air of the desorption air stream 15 takes up the same amount of liquid or respectively, water vapor that previously was brought into the sorption agent 10 by a larger first quantity of air of the cooling air stream 7. The absolute moisture content of the second quantity of air therefore is considerably larger so that its dew point temperature is higher than the dew point temperature of the cooling air stream 7.

With a suitable embodiment of the volume flow rates as well as of the container 9 it is possible to achieve that the dew point temperature of the desorption air stream 15 is higher than the ambient temperature.

In a subsequent step of the method only the desorption air stream 15 that is enriched with moisture from the sorption agent 10 must be guided through a heat exchanger 16 and must be cooled to below the dew point temperature in order to provide for a condensation of the moisture contained in the desorption air stream 15 and thus for a reclaiming of the liquid contained in the desorption air stream 15. The precipitated liquid can be collected and used for evaporative cooling 8 again.

The energy required for supplying heat and the equipment that produces the flow can be generated by means of solar collectors 17 and can be supplied to the respective energy consumers. The chiller 1 therefore can be operated solely with solar energy without using any water, thus allowing for an inexpensive and economic air conditioning of premises 5 in hot geographic regions as well.

It also is feasible to use the above described reclaiming of moisture from an air flow fir extracting drinking water from salt water or, respectively, sea water. The vapor contained in an air flow that is generated when sea water is vaporized or, respectively, evaporated, can be transferred into a second air flow whose dew point temperature is substantially higher and allows for an economic precipitation or, respectively, condensing of the water.

An example of the course of the method for extracting drinking water from ambient air is shown in 4. Ambient air is suctioned from the surroundings 18 by means of a ventilator 19. The ambient air has a temperature of 45° C., for example, and a relative humidity of 15% so that the ambient air contains approximately 9 g/kg evaporated water. First, the ambient air is cooled to 28° C., for example, in a cooling device 20 and then is guided through the container 9 that contains the sorption agent 10 in a plurality of chambers 11. A share of the moisture contained in the ambient air is taken up in the sorption agent 10 and stored. When using suitable sorption agents, approximately 7.6 g/kg water can be extracted from the ambient air that was cooled to 28° C. before. The dehumidified and simultaneously heated ambient air is routed back to the surroundings.

A process air stream 22 is circulated in a closed cycle 21. The process air stream 22 is heated by means of a solar collector arrangement 23 and subsequently flows through the container 9 at a temperature of 75° C., for example, and relative humidity of 33% to take up the moisture that is stored there. In the process the relative humidity of the process air stream 22 increases to 74% for example, so that the process air stream 22 has taken up approximately 153 g/kg water.

Each kilogram of the process air therefore can take up the amount of water that is transferred into the sorption agent by approximately 20 kilograms ambient air and is stored there. This means that the first air volume is approximately the 20-fold volume of the second air volume.

In a next step of the method the process air stream 22 is guided through a heat exchanger 16 and is cooled to 51° C., for example, by means of the ambient air 18 with to temperature of 45° C. that is also suctioned off by means of a ventilator 19. In the process the relative humidity first increases to 100% and then condenses a share of the moisture contained in the process air stream 22. With the examples of the temperature and humidity values described above, approximately 153 g/kg water are condensed when the process air stream 22 is cooled to 51° C. This amount of water can be removed from the process air stream 22 by means of a drain 24 and can be collected in order to provide drinking or useable water extracted from the ambient air. The energy required for the operation of the ventilators 19 and heating the process air stream 22 can be obtained by means of photovoltaic systems or solar collectors 23, respectively, so that it is possible to extract drinking water from ambient air efficiently, particularly in dry and hot geographic regions.

The invention claimed is:

1. Method for reclaiming an evaporated liquid from an air stream, comprising transferring the evaporated liquid from a first quantity of air into a second quantity of air, wherein the second quantity of air is smaller than the first quantity of air, wherein the second quantity of air is circulated in a closed cycle, and wherein the first quantity of air is circulated in a closed cycle and evaporative cooling occurs within the closed cycle in which the first quantity of air is circulated.

2. Method according to claim 1, wherein the evaporated liquid from a first quantity of air is sorbed in a sorption agent and then desorbed in a second quantity of air, wherein the second quantity of air is smaller than the first quantity of air.

3. Method according to claim 1, wherein the first quantity of air and the second quantity of air have the same atmospheric pressure.

4. Method according to claim 3, wherein the atmospheric pressure substantially corresponds to the atmospheric pressure of the ambient air.

5. Method according to claim 1, wherein the second quantity of air for a desorption of a specified amount of liquid from the sorption agent is smaller than a marginal quantity of air whose dew point temperature corresponds to a specified minimum temperature after taking up the desorbed amount of liquid.

6. Method according to claim 1, wherein the specified dew point temperature of the second quantity of air is greater than an exterior temperature under typical operating conditions.

7. Device for carrying out a method for reclaiming evaporated liquid from a first quantity of air wherein the evaporated liquid is adsorbed in a sorption agent and then desorbed in a second quantity of air, comprising a container having a plurality of rotationally supported chambers filled with the sorption agent and permeable by an air flow, a first closed cycle in which the first quantity of air is circulated to guide an air flow through at least one chamber of the container, the first cycle including an evaporative cooler, and a second closed cycle in which the second quantity of air is circulated to guide an air flow through at least one chamber of the container and subsequently through a heat exchanger.

8. Device according to claim 7, wherein the device comprises a collecting setup for liquid condensed from the second quantity of air.

9. Device according to claim 7, wherein the container comprises circularly disposed, rotationally supported chambers filled with the sorption agent and comprising inflow openings as well as outflow openings disposed at a distance for the air flow.

* * * * *